US005957340A

United States Patent [19]

Sawicki

[11] Patent Number: 5,957,340

[45] Date of Patent: Sep. 28, 1999

[54] CONTAINER WITH SURMOUNTING BELLOWS PUMP

[75] Inventor: Craig Sawicki, Elk Grove Village, Ill.

[73] Assignee: W. Braun Company, Chicago, Ill.

[21] Appl. No.: 09/067,823

[22] Filed: Apr. 28, 1998

Related U.S. Application Data

[63] Continuation-in-part of application No. 29/085,025, Mar. 16, 1998.

[51] Int. Cl.[6] ..... B65D 37/00

[52] U.S. Cl. ..... 222/209; 222/211

[58] Field of Search ..... 222/209, 211, 222/464.1

[56] References Cited

U.S. PATENT DOCUMENTS

| | | | |
|---|---|---|---|
| 3,398,427 | 8/1968 | John | 222/464.1 |
| 4,645,097 | 2/1987 | Kaufman | 222/211 |
| 4,966,312 | 10/1990 | Waring | 222/209 |
| 5,307,956 | 5/1994 | Richter et al. | 222/464.1 |

FOREIGN PATENT DOCUMENTS

| | | | |
|---|---|---|---|
| 405270576 | 10/1993 | Japan | 222/209 |

*Primary Examiner*—Philippe Derakshani
*Attorney, Agent, or Firm*—Michael G. Berkman

[57] ABSTRACT

A container for housing fluid material to be dispensed in incremental amounts. A conduit integrally formed with the container and in fluid-flow communication therewith serves to deliver material from the container upon generation of gaseous pressure within the body of the container above the physical level of the material stored therein. The container also includes a restricted filling port fitted with a closure cap. Interposed between the port and the body of the container, in coaxial disposition therewith, is a bellows assembly. The latter surmounts the container in fluid communication therewith, whereby application of manual or digital pressure downwardly upon the capped container effects physical compression of the bellows to force a volume-controlled and repetitively-rerproducible, incremental quantity of stored material from an open, exposed end of the fluid-delivery conduit for use. Withdrawal of compression forces applied to the bellows, and resultant responsive physical re-expansion of the bellows, effects, automatically, a vacuum-derived positive and forceful clearing of residual material from a lineal end sector of the product delivery conduit. Any dripping of material from the open end of the conduit is also obviated.

7 Claims, 3 Drawing Sheets

CONTAINER WITH SURMOUNTING BELLOWS PUMP

This is a continuation-in-part of application Ser. No. 29/085025 filed Mar. 16, 1998.

FIELD OF THE INVENTION AND BACKGROUND

The present invention relates to a storage vessel or container fitted with a product delivery pump. More particularly, the invention is directed to a unitary, integrally-formed container or reservoir from which a stored fluid product may be readily dispensed through a discharge conduit supported on the container body and integrally formed therewith. A very significant particular feature of the subject invention is that the product delivery pump constitutes a bellows assembly integrally formed with and supported on the body of the container in coaxial alignment therewith.

Product storage and dispensing containers provided with delivery pumps, including bellows type pumps are known in the art. Such hand-operated pumps have taken varied physical forms. Some configurations have proven difficult to grasp and manipulate. Others are hard to control as to volume of product delivered or dispensed. Still others have been unduly cumberson, lacking aesthetic appeal. Some devices of the general type here referred to have been complex and unreliable. Still others have been quite costly to manufacture. Manufacturing or fabrication and assembly problems have contributed to the difficulties experienced.

It is, therefore, a principal aim of the present invention to provide a simple, aesthetically-attractive yet operationally reliable and superior combination storage assembly and dispensing pump with enhanced control over volume increments dispensed, and which obviates many of the shortcomings of earlier devices.

SUMMARY OF THE INVENTION

The present invention comprises a storage vessel or container which serves also as a pump for controllably dispensing a fluid product stored in the body chamber or reservoir of the container. It is a feature of the invention that the mechanism by which the fluid product is forcibly and controllable dispelled from the storage chamber of the container is a pump of the bellows type.

A critical and crucial feature of the invention is that the bellows of the pump is physically positioned between the body of the container and the filling port of the container, in coaxial alignment with a vertical axis of the container. A related feature of the invention is that the surmounting port through which the container is filled is coaxial with the bellows and with the the principal (vertical) axis of the container.

A significant practical and advantageous feature of the invention is that it is not necessary that one grip or grasp the container in order to actuate the bellows of the pump and effect the discharge of material from the container-dispenser of the invention. Rather, it is required only that one apply digital pressure downwardly on the top (capped port) of the assembly. All this can be conveniently done without lifting the storage and dispensing container of the invention from its supporting substrate.

Another useful and important feature of the manually or digitally-actuated bellows pump of the invention is that its particular mechanical arrangement makes it practical for one to actuate the pump and to deliver the thus-expelled material into or onto the same hand being used to compress the pump bellows. One's other hand is left completely free for other auxiliary, or related tasks.

It is a feature of the bellows pump dispenser of the invention that manually-effected, repeated, fully compacted successive compactions of the bellows of the pump are effective to discharge and to deliver from said container substantially equal incremental fluid volumes for each successive, repeated actuation of the bellows of the pump.

A practical feature of the invention is that the assembly is fabricated of a resilient plastics composition exhibiting high strength and a long useful life.

A related feature of the container and bellows pump assembly of the invention is that the structure is molded as a unit, including also a fluid-delivery conduit terminating in a product delivery spout.

In a preferred embodiment of the invention the fluid delivery conduit is physically supported and mechanically stabilized by physical attachment to the body of the container through a connecting, elongated web, the latter extending along substantially the full height expanse of the storage container.

A related feature of the invention is that the bounding, vertically-encircling, circumscribing wall of the container tapers upwardly from an enlarged, generally ellipsoid base to a reduced, essentially round annular shoulder structure which supports the integrally formed bellows component of the invention.

An important physical feature of the assembly is that the fluid-delivery conduit terminates at its upper extremity in an integrally-formed, outwardly-directed spout section. This spout section may also function as a mechanical, hand-engaging rest or stop to prevent the container from slipping from the user's grasp.

It is a related feature of a preferred embodiment of the invention that the fluid-delivery conduit is integrally formed at its upper end with a restricted discharge orifice or port.

Yet another feature of the container and pump assembly of the invention is that the bellows-surmounting section of the container is integrally formed to define a short, restricted, neck-like sector. This sector defines a filling port and is provided with a closure cap, the latter being either threaded or of a snap-on type.

It is an important feature of the invention that upon cessation of the impression of compressing forces downwardly upon the bellows of the pump, the bellows revert to their normal, expanded configuration. During such physical recovery and expansion, vacuum forces are developed in the container. Such forces act effectively to draw ambient air into the product delivery conduit to effect a clearing of the conduit of material which might otherwise harden and result in a clogging of the discharge port of the delivery tube.

The physical shape, contour, or components of the bellows pump containers of the invention are not, per se, individually critical. In a preferred embodiment of the invention there is included an accordian-like bellows array or assembly which is in axial alignment with a vertical axis of a container on which the bellows assembly itself is integrally mounted. The pleats or fold sections of the bellows may be digitally or manually compressed without any need for the user either to grasp or grip the assembly, or to lift the pump and product-storage assembly from a supporting substrate.

In accordance with one mode of employing the invention, it is practical manually to compress the bellows and deliver product to the same hand used to actuate the bellows to effect discharge of stored material from the reservoir of the container.

Other and further features and advantages of the invention will be evident upon review of the following detailed description considered in conjunction with the drawings.

DESCRIPTION OF THE ILLUSTRATED EMBODIMENT

Figure 1:
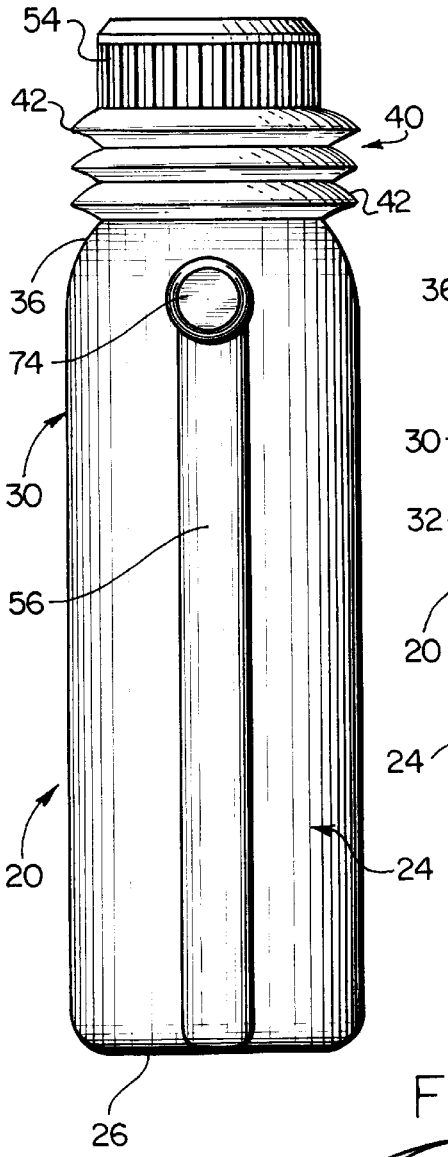
FIG. 1 is a front elevational view of a bellows-actuated pump surmounting a dispenser container, in accordance with the present invention.
Figure 2:
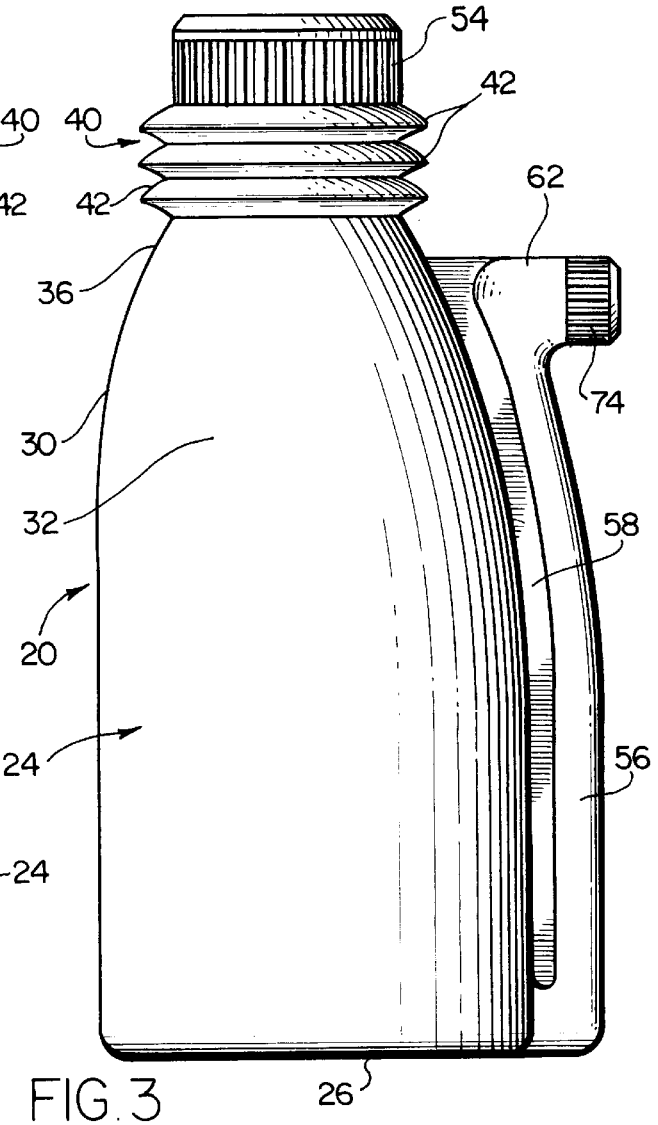
FIG. 2 is a side elevational view thereof.
Figure 3:
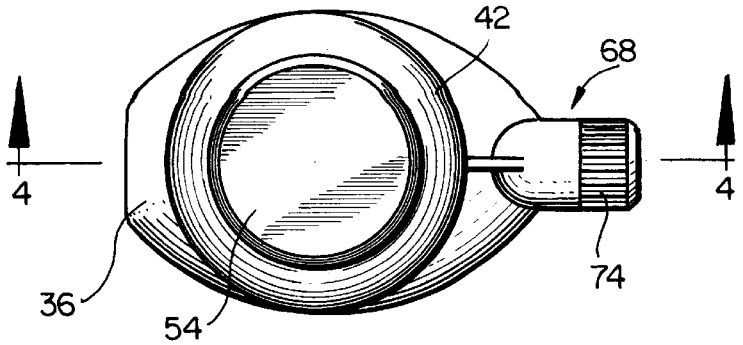
FIG. 3 is a top view thereof.
Figure 4:
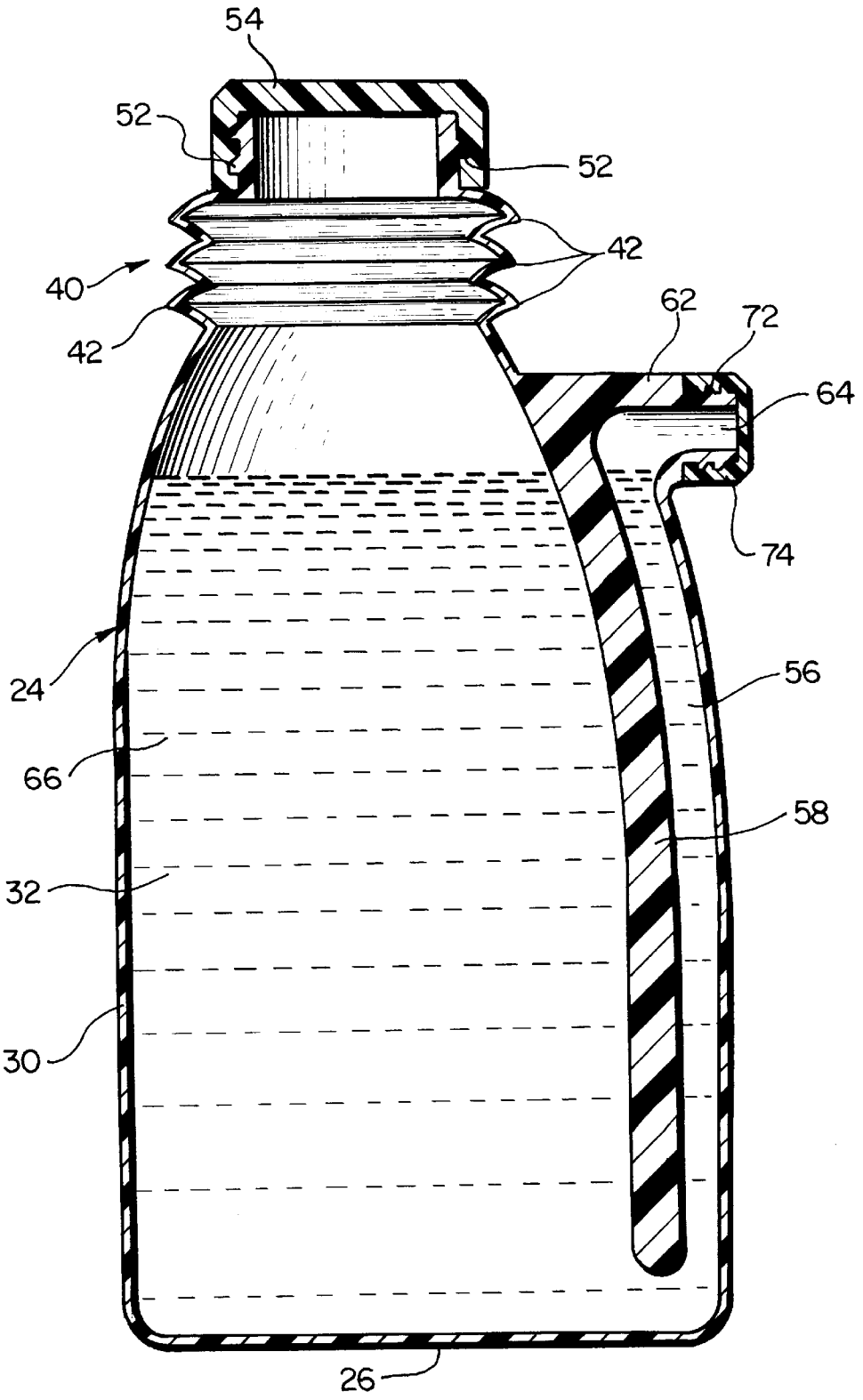
FIG. 4 is a longitutinal cross-sectional view taken substantially on the lines 4—4 of FIG. 3.

The aims and objects of the invention are achieved by providing in a product storing and delivery container a bellows-type, manually-actuable pump which surmounts the body of the container in coaxial orientation therewith. Integrally formed with and extending upwardly from the bellows assembly and in fluid communication with the interior of the bellows' cavity is a short neck defining a port through which the container is conveniently filled. The upper opening or port is fitted with a suitable closure cap. A product delivery tube communicating with the interior of the container at the bottom of the container is integrally formed with the container to extend upwardly therealong, on the outside of the container. At its upper end, the conduit is bent to define a relatively short outwardly-projecting sector terminating in a product-delivery orifice. The latter may be provided with a removable closure cap, as desired.

In accordance with the structure described, in order to dispense a finite, controlled and reproducible, quantity of material from the container for use, it is necessary merely to press digitally or manually down upon the capped container to compress the pleats of the bellows pump. In a preferred embodiment of the invention the entire unitary structure is fabricated of suitable plastics material in a blow molding operation.

Referring now to the drawings, for purposes of disclosure, and not in any limiting sense, a preferred embodiment of the combination storage vessel and bellows pump assembly 20 of the invention is depicted. As shown, the assembly 20 includes a container or vessel body 24 with a base or floor 26. The latter is integrally joined to a circumscribing, upwardly-directed wall 30 defining a fluid storage chamber or reservoir 32. The wall 30 bounding the chamber 32 converges inwardly at an upper section 36 and is surmounted by a bellows pump assembly 40 which, in the particular embodiment of the invention depicted comprises three accordian pleats or fold sections 42. The number is not critical. Supported on and coaxial with the pump assembly and the body 24 of the assembly 20 is a short neck 44 defining a port 46 through which the container 24 is conveniently filled. In the particular embodiment of the invention illustrated the neck 44 is formed with threads 50 for accommodating a threaded cap or closure 54.

Connected into the the container wall 30 at a forward extremity of the floor or base 26 where the wall 30 joins the base 26 is a tube or conduit 56. The latter is spaced from and extends upwardly along and parallel to and outside of the container wall 30. Along its entire vertical expanse the tube 56 is integrally fastened to the container wall 30 by a web 58. At an upper limit, the conduit 56 is formed with a forwardly directed spout section or sector 62 terminating in a discharge orifice 64 through which product 66 stored in the chamber 32 is dispensed when the bellows 40 is compressed, as occurs upon the application of pressure downwardly thereupon. The terminating end portion 68 of the spout sector 62 is shown in the illustrated embodiment of the invention as being formed with threads 72 for accommodating a threaded cap 74.

It will be understood, upon consideration of all of the drawings in conjunction with the detailed description set forth above, that, with the container 24 supported on a substrate 80 such as a table or counter, (FIG. 5), or otherwise supported or physically stabilized, that upon the application of pressure downwardly, either digitally or manually, etc., upon the top 82 of the cap 54 of the container 24, the bellows 40 is compressed. Fluid pressure is applied, in turn, to bear upon the top surface 84 of the product 66 stored in the container 24. The generated pressure forces the stored material 66 upwardly through the conduit 56 to be dispelled from the discharge orifice 64 at the end of the conduit 56, all as indicated schematically in FIG. 5.

Figure 5:
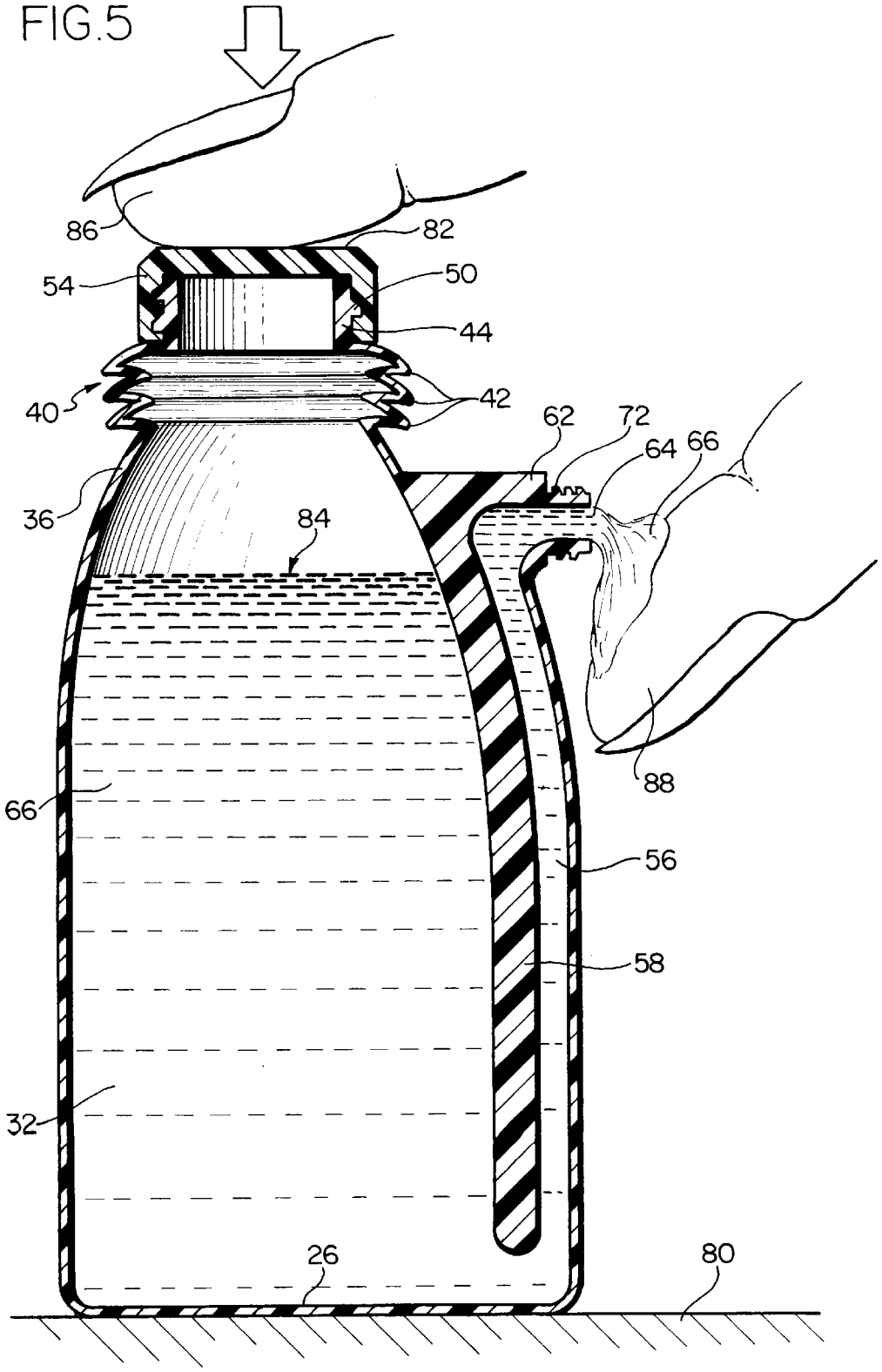
FIG. 5 indicates, schematically, the manner in which digital pressure applied downwardly to compress the bellows of the dispensing and delivery pump is effective to dispense from the storage container a controlled quantity of material, and to deliver the material onto a finger of the same hand employed to activate the pump.

Referring further to FIG. 5, a unique feature of the present invention, there illustrated schematically, is that the configuration and physical arrangement, and mode of operation of the components of the product storing and dispensing device 20 makes it readily feasible to actuate the device with one's hand and deliver the discharged product to, or onto, the same hand used to compress the bellows 40. As shown in FIG. 5, the forefinger 86 is used to press downwardly on the top of the assembly, and the product being discharged is delivered to the thumb 88 of the same hand. It is not necessary either to grip, grasp, or lift the container 24.

An extremely useful feature of the present invention is that each successive actuation of the bellows results in the delivery of essentially the same incremental quantity of material from the container 24.

What is claimed is:

1. A container for storing and for positively dispelling and delivering therefrom fluid compositions contained therein, said container comprising a body defining a fluid reservoir, said body including a floor-like base, and walls extending upwardly thereof, a vertically-compressible bellows integrally formed with and surmounting said walls of said container as a coaxial extension thereof, said bellows defining an interior zone in fluid flow communication with said fluid reservoir of said container, a neck-like collar integrally formed with, and coaxial with, and mounted on said bellows at an upper limit thereof, said collar being formed with an upwardly-opening port through which said container is filled, cap-like closure means for sealing said port after introduction of a fluid composition into said reservoir, tubular conduit means including dispenser tube means integrally formed with and supported exteriorly of and radially outwardly of diametric bounds of said container for establishing fluid flow communication with said reservoir at a locale adjacent said base of said container, said conduit means projecting upwardly of said base and extending within vertical limits consistent with upper and lower bounds of said body of said container, said conduit means having a terminal discharge end, a nozzle integrally formed with said dispenser tube means at said terminal discharge end thereof, orifice means at said terminal discharge end of said conduit means for delivery of a fluid composition positively dispelled from said reservoir upon application of downwardly-directed, manually impressed compression forces to said bellows of said container, web means projecting outwardly of and extending along said wall means for connecting said wall means with said tubular conduit means for supporting and for stabilizing said conduit means; and said web means being integrally formed with said wall means and with said conduit means, and extending along an upward reach of said conduit means.

2. In a container for storing and for positively dispelling and delivering fluid compositions contained therein, said container comprising a body defining a fluid reservoir, and said body including a floor-like base, wall means projecting upwardly of said base, and said container including a neck defining a port through which said container is filled, closure means for sealing said port after introduction of a fluid composition into said reservoir, tubular conduit means including dispenser tube means integrally formed with and supported exteriorly of and radially outwardly of a diametric limit of said container for establishing fluid flow communication with said reservoir at a locale adjacent said base of said container;

said conduit means projecting upwardly of said base and extending within limits defined by lower and upper bounds of said body of said container, and said conduit means having a terminal discharge end;

a nozzle integrally formed with said dispenser tube means at said terminal discharge end thereof for discharge of material therefrom;

web means projecting outwardly of and extending along said wall means for connecting said wall means with said tubular conduit means for supporting and for stabilizing said conduit means;

said web means being integrally formed with said wall means and with said conduit means, and extending along an upward reach of said conduit means; and orifice means at said terminal discharge end of said conduir means for delivery of a fluid composition positively dispelled from said reservoir;

the improvement comprising:

bellows means interposed between and integrally formed coaxially with said body and said neck of said container for developing increased pressure in said reservoir and against the fluid composition housed therein, thereby to drive the fluid composition through said tube means of said conduit means to be dispelled from said nozzle at said terminal discharge end of said dispenser tube means.

3. A container as set forth in claim 2, wherein said nozzle of said dispenser tube projects laterally outwardly to define an angle, therebelow and with the vertical, of greater than 90 degrees, thereby to ensure that residual fluid clinging to inside walls of said nozzle after the container has been used would tend to return to the interior of the container.

4. A container as set forth in claim 2 in which manually-effected, repeated, fully compacting compressions of said bellows means is effective to discharge and to deliver from said container substantially equal incremental fluid volumes of material for each successive, repeated actuation of said bellows means.

5. A container as set forth in claim 2, wherein release of said bellows means after compressive compaction permits automatic re-expansion of said bellows means and is effective thereby to develop a partial vacuum in said container, and to draw ambient air inwardly into said dispensing nozzle, thereby to establish forces effective to urge, inwardly toward said reservoir, any residual material remaining in said fluid nozzle, to clear said nozzle.

6. A container as set forth in claim 2, characterized in that actuation of said bellows means to effect delivery of material from said reservoir is conveniently achieved by merely exerting downward pressure upon said closure means of said container, obviating any need manually to grasp and grip the container, and obviating any need to lift the container from a supporting substrate.

7. A container as set forth in claim 2, characterized in that it makes it conveniently possible and practical, using a single hand only, digitally to apply actuating compressive forces to said bellows means and simultaneously to deliver the dispelled material to the same hand employed to compress said bellows means.

* * * * *